United States Patent [19]

Stuckey

[11] Patent Number: 4,678,341

[45] Date of Patent: Jul. 7, 1987

[54] INTEGRATED LIQUID DISTRIBUTION APPARATUS

[76] Inventor: William C. Stuckey, 1503 Virginia St., East, Charleston, W. Va. 25311

[21] Appl. No.: 734,732

[22] Filed: May 16, 1985

[51] Int. Cl.[4] ..... B01F 15/00

[52] U.S. Cl. ..... 366/142; 239/142; 239/310; 239/74; 366/143; 366/250; 366/280; 137/553; 137/893

[58] Field of Search ..... 366/241, 244, 245, 250, 366/252, 262, 280, 150, 152, 154, 155, 160, 161, 162, 163, 165, 167, 168, 138, 142, 143; 239/124, 142, 310, 74; 137/895, 893, 553; 417/63

[56] References Cited

U.S. PATENT DOCUMENTS

| | | | |
|---|---|---|---|
| 1,109,682 | 9/1914 | Kassander | 137/895 |
| 1,200,301 | 10/1916 | Bigelow | 366/250 |
| 2,191,717 | 2/1940 | Seffeay | 417/63 |
| 2,215,132 | 9/1940 | Parker . | |
| 2,356,186 | 8/1944 | Timpson | 137/893 |
| 2,600,877 | 6/1952 | Jeffree | 239/310 |
| 2,741,997 | 4/1956 | Parker . | |
| 3,099,394 | 7/1963 | Lynn . | |
| 4,159,258 | 5/1979 | Duda . | |

*Primary Examiner*—Robert W. Jenkins
*Attorney, Agent, or Firm*—Jim Zegeer

[57] ABSTRACT

A liquid distributing apparatus, particularly for incorporation in lids or covers of 3 to 5 gallon containers, has a four-way input valve for delivering water under pressure to wash hands, clean material, etc., fill the tank on which the lid is placed and to drive rotor shafted to a spur gear which drives an agitator for keeping the concentrate in the tank stirred-up, with a manual input for initially stirring-up or agitating the concentrate. An indicator is provided on the manual drive to show that the agitator (and hence the rotor) is operating. An aspirator or jet pump receives the liquid or water downstream of the rotor and the input aspirator or vacuum line from the concentrate or tank passes through a ball check valve which has an indicator coupled thereto for indicating the flow of concentrate from the tank to the jet pump to be mixed with the water. A valve with predetermined controls the degree or ratio of concentrate. A pressure meter on the input to the jet pump measures the input water pressure and has a gauge for indicating, for corresponding pressures and predetermined openings of the needle valve, what is the degree or ratio of concentrate to water being delivered to the place of utilization such as herbicides, insecticides and fertilizers. Moreover, the ball valve is provided with a flag indicator which, according to the degree of protrusion, provides a further indication of the ratio of concentrate being delivered to be mixed with the water.

25 Claims, 19 Drawing Figures

16
10
80
140
130
49-1H
30
49-3H
34
PF
65
49-2H
40
70
16
169
170
11
FH
16
MC
RS 47-3
49-30
41
30
42
34
65
47-1
49-3
48-3
44
IN
49-1
48-1
49-2
43S
48-2
49-10
47-2
49-20
45
43
43-1

FIG. 4
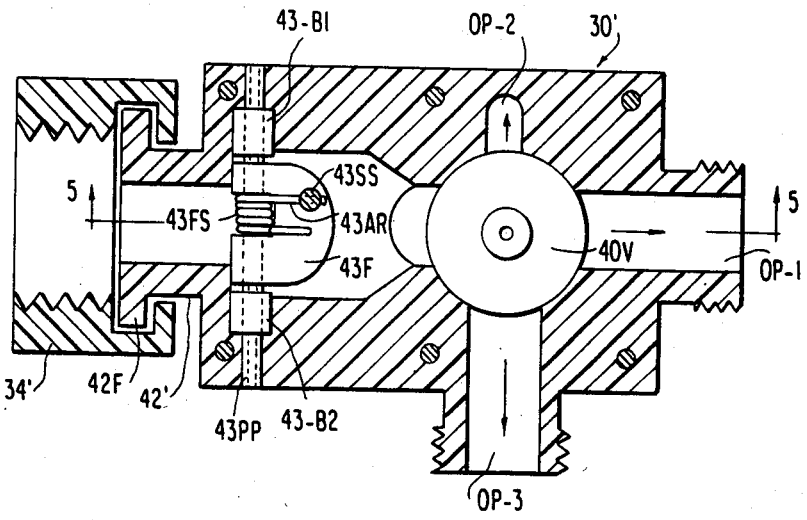
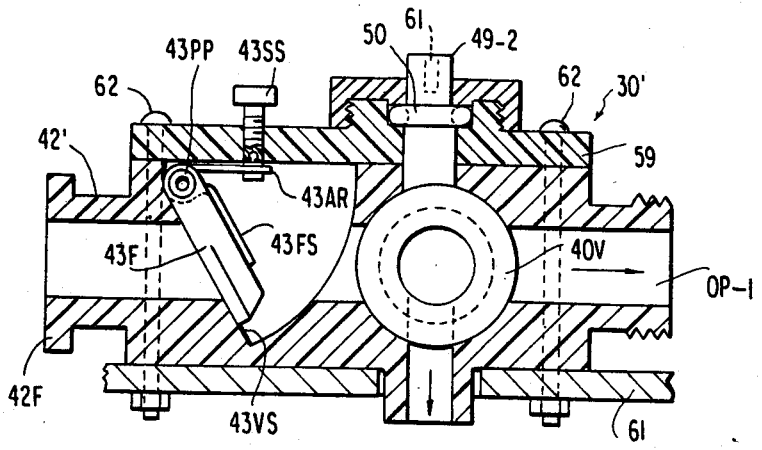
FIG. 5

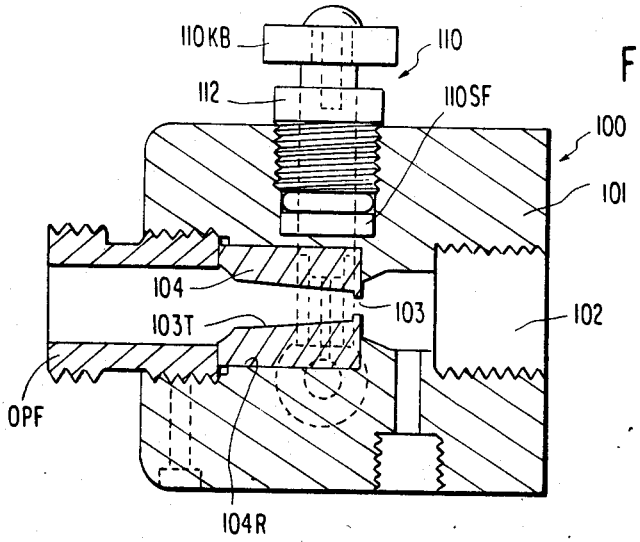
FIG. 11a
FIG. 11b
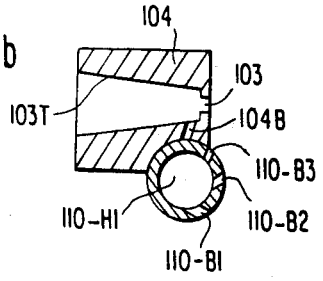
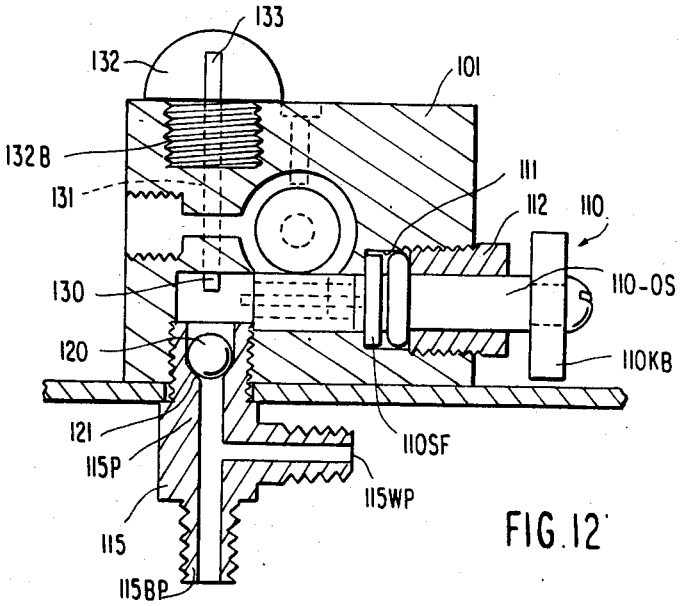
FIG. 12

INTEGRATED LIQUID DISTRIBUTION APPARATUS

BACKGROUND AND BRIEF DESCRIPTION OF THE INVENTION

This invention relates to improvements in liquid distributing apparatus and, more particularly, to apparatus especially for plant treatment substances such as herbicides, insecticides, fertilizers and the like, particularly for mixing such substances with water to assist the user to more accurately apply prescribed amounts of these highly dangerous, and in many cases, toxic substances in a safe and efficacious manner, said apparatus being a relatively simple and inexpensive design. In addition to use in plant treatment applications, the invention has utility in washing situations where a prescribed amount of detergent are to be mixed with water for cleansing airplanes, cars and the like and also to situations in mines where water and water based substances are used for dust control purposes. Other uses will be readily apparent to those skilled in the art.

Parker U.S. Pat. Nos. 2,215,132 and 2,741,997 discloses a method and apparatus for distributing liquid solutions, particularly liquid fertilizers, insecticides, fungicides, weed killers and other chemical solutions through a conventional garden hose with ordinary pressure and wherein a water jet pump has a suction tube immersed in a pail carrying the substances being distributed and in actual devices marketed under the Parker patent various check valve arrangements and the like have been incorporated to prevent contamination of water upstream of the jet pump. This device lacked a means of agitating the liquid solution being applied and a means of metering the concentrate solution which features are disclosed in Lynn U.S. Pat. No. 3,099,394. The system disclosed in Lynn U.S. Pat. No. 3,099,394 utilized a portable turbo jet spraying device in which a cover on a container carried a water driven rotor to which was secured an agitator which was rapidly rotated by the rotor so that insoluble materials are maintained in suspension and the water, after driving the rotor is sent through the jet pump or aspirator in which a calibrated needle valve was provided in the flow path in jet tube so as to provide a metering arrangement for controlling the concentration of the material to be sprayed. As noted earlier, check valves are commonly utilized to prevent dissolved material from passing upstream of the apparatus to contaminate the incoming clear water, and such an arrangement is shown in Duda et al. U.S. Pat. No. 4,154,258.

THE PRESENT INVENTION

In accordance with the present invention, a liquid dispensing apparatus includes a cover for a container, particularly a container in the 3 to 5 gallon range which is relatively easy to handle by the user, such as a farmer or gardener, and in one embodiment are stackable with the lid incorporating the present invention in a protected way. The lid has means forming a liquid entrance passage with a fitment for coupling to a garden hose, for example, and a liquid outlet passage for coupling to a hose leading to a dispensing nozzle. Between the liquid entrance passageway and the liquid exit passage are provided in the following order:

A check valve, sometimes called an automatic anti-siphon valve to prevent water which may have a chemical therein in the dispensing system from flowing back into the clean water supply line, the check valve may be formed in the present case as an integral portion of a four-way valve system. The four-way valve system include one output passage leading to a tube for filling the container with a prescribed amount of water. This permits the mixing of the constituent in the container in a safe and efficient way away from the eyes and while the cover is on the container and there is no splash. In a second position, water is directed to a rotor chamber housing a rotor which is to be driven by the water and which will be described more fully hereafter, and finally to an outlet which can be used to fill extra pails, safely, shut-off the tank and wash the hands, and to provide a way of obtaining clean water at the tank.

The rotor referred to earlier herein is coupled through a gearing (step down or a step up depending on the substance to be dispensed) to an agitator or stirrer shaft having a stirrer below the end thereof. The gearing is a spur gear which has a manual drive shaft coupled thereto to which a removable crank handle can be applied so as to manually drive the agitator directly. This permits the user to agitate the substances in the tank prior to even turning on the water and can be used in addition to water driving the rotor to agitate the substances in the tank thereby assuring a more uniform concentrate in the tank. A further feature of the manual drive is that the shaft has an indicator thereon so that when the rotor is being driven by the power of the water, the end of the shaft can visually indicate operation of the rotor and hence agitation of the concentrate in the tank. Water from the rotor is utilized to drive a siphon or jet pump of the type generally disclosed in Parker U.S. Pat. No. 2,215,132, which is incorporated herein by reference. The siphon or jet pump includes an orifice of reduced section leading to an expanding passageway in the outlet wherein water mixed with metered concentrate or pure water can be delivered to the utilization point. The vacuum or suction line from the siphon or jet pump leads to a flexible tube that is maintained in the concentrate water solution.

A gravity operated ball check valve is provided in the vacuum line and a visual indicator is operated by the ball check valve so as to indicate to the user that the jet pump is operative and is dispensing the concentrate in a prescribed manner. A mixture adjusting valve which is adjustable to several fixed or known positions is also in series with the ball check valve so as to control the amount of concentrate delivered through the suction tube to the jet pump per se. A pressure gauge may, if desired, provided on the upstream side of the jet pump and is provided with a calibrated scale to indicate the pressure of the water in the siphon or jet pump housing and in association with the mixture adjusting valve, the ratio of concentrate to water being delivered at any given pressure and any given mixture adjusting valve setting.

BRIEF DESCRIPTION OF THE DRAWINGS

The above and other objects, advantages and features of the invention will become more apparent when considered with the following specification and accompanying drawings wherein:

FIG. 4 is a modification of the multiple output valve structure of FIG. 1, FIG. 5 is a sectional view through lines 5—5 of FIG. 4, FIG. 11 is a side sectional view on lines 11—11 of FIG. 1, FIG. 12 is a side sectional view of the jet pump and metering valve and indicator assembly shown in FIG. 1, FIGS. 13 and 14 are side sectional and top sectional views of a modification of the mixture control valve.

DETAILED DESCRIPTION OF THE INVENTION

Figure 1:
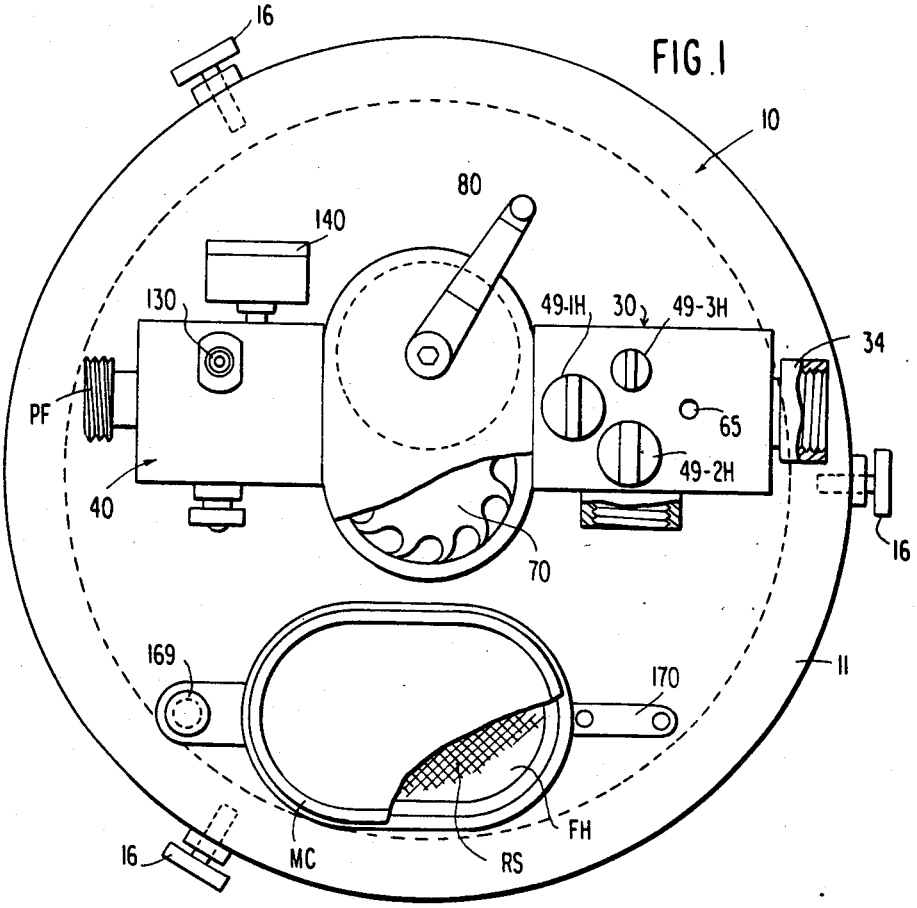
FIG. 1 is a top plan view of a lid or cover for a three to five gallon container of a substance to be dispensed and incorporating the invention.
Figure 8A:
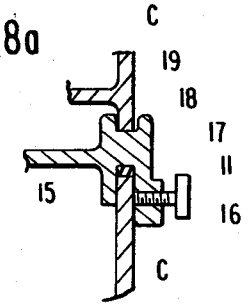
FIG. 8*a* is a partial sectional view showing a modification of the edge or rim of the cover.

Referring now to FIG. 1, a cover or top 10, which in the preferred embodiment is for a 3 to 5 gallon container or pail (FIG. 2) is provided with an annular rim 11 having a lower surface 12 (FIG. 5) adapted to sealingly engage the top 13 of a pail or container. The lower edge 12 has an annular groove notch 14 formed therein and a seal gasket 15 in the base of the annular groove 14 and a plurality of spaced knurled locking nuts 16 engage the outer surfaces of the upper edge of the pail 13 to secure the lid to the pail or container. As shown in the modification of FIG. 8*a*, the upper edge 17 of the annular rim 11 may be provided with an annular groove or notch 18 into which the lower edge 19 of an upper container 20 rests or sits. It will be appreciated that the crank handle 80 in this case would be removed and stowed in a locking clip or a spring finger (not shown) secured to or integrally formed in the annular rim 11.

As shown in FIG. 1, easy access is had to threaded female coupler 34 on the input multiway control valve 30. The knurled locking members 16 can be supplied or attached at a later time after fitment of the cover or lid on the container C. The container itself may be provided with a carrying handle or bale on the sides thereof below the rim or, alternatively, a carrying handle (not shown) may be integrally cast as a top part of the housing of the apparatus. The water drives an impeller 70 which is geared to an agitator on the shaft on which handle 80 is fitted and the water then operates a jet pump 40 and delivers a mixture of water and concentrate in a predetermined ratio to the outlet PF, threaded to receive a male hose fitting. Meter 140 displays water pressure and concentrate ratios and indicator 130 indicates operation of the jet pump.

Figure 2:
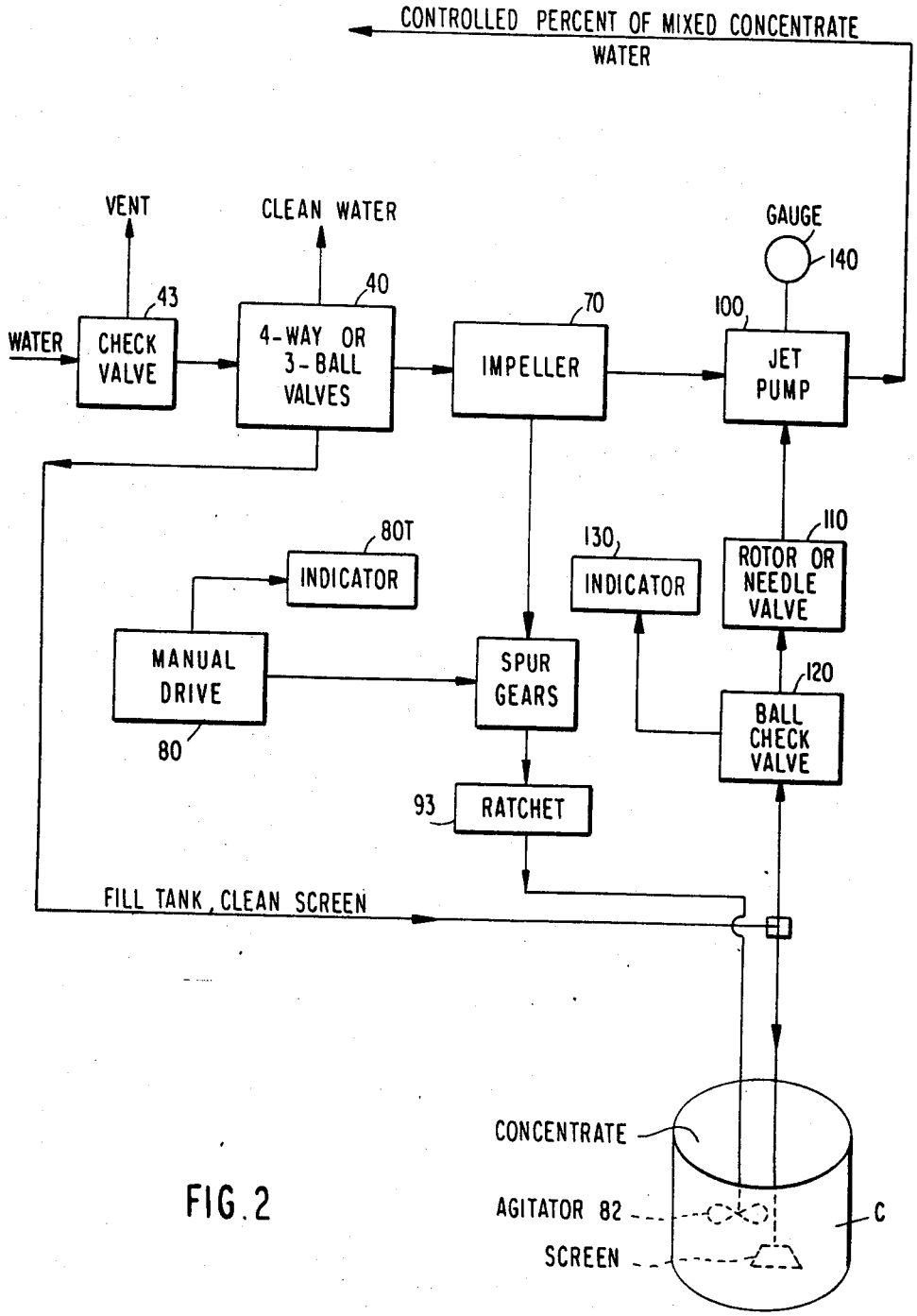
FIG. 2 is a block diagram of the flow of the system incorporating the invention.
Figure 6:
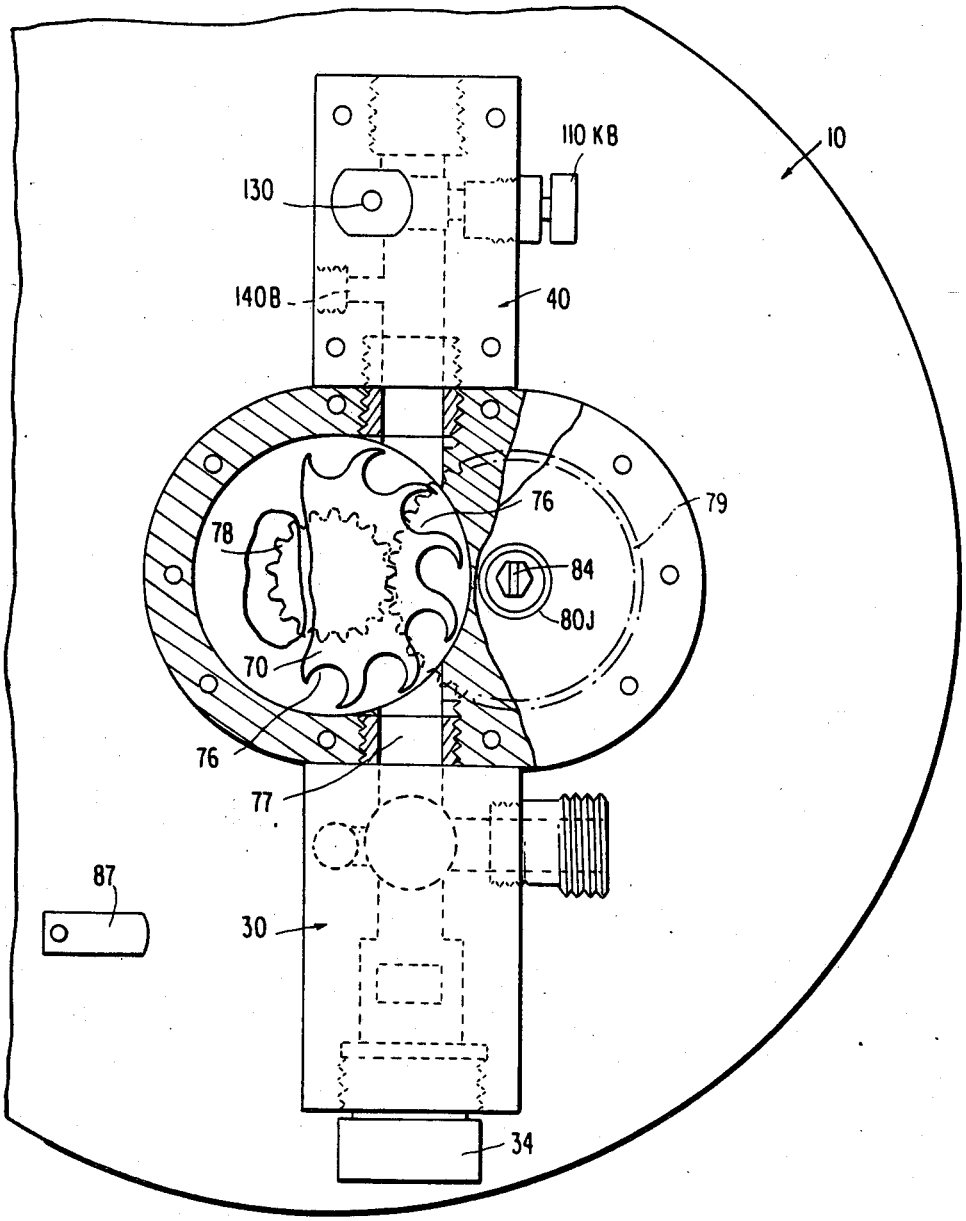
FIG. 6 is a partial cut-away view of a top portion of the rotor and gear drive assembly for the agitator illustrating the ratchet lock.

As the following discussion of the internal workings and portions of the apparatus proceed, it may be well from time-to-time to refer to FIG. 2 which is a schematic block diagram of the different functions and features of the apparatus. The input valve structure 35 is shown in detail in the two embodiments shown in FIGS. 3, 4 and 5.

Figure 3:
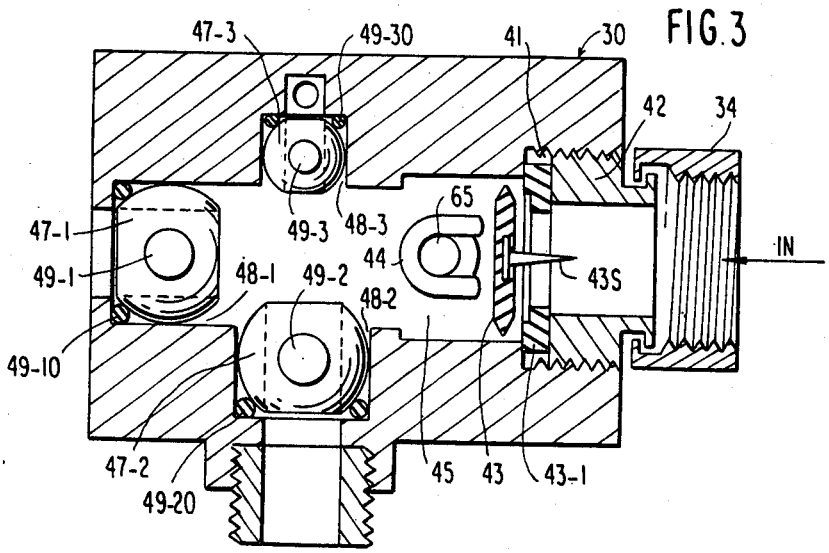
FIG. 3 is a sectional view through the multiple output valve structure of FIG. 1.

In the multiple valve embodiment of FIG. 3, a conventional brass female fitting 31, into which the male threads of a garden hose, for example, is secured, is rotatably carried by brass fitment 42 which is threadably received in bore 41 in multiple valve body housing 40. Check valve washer 43 is maintained in position by coupler fitment 42 threadably engaged with bore 41. Annular elastomeric anti-siphon check valve element 43-1 sealingly engages elastomeric check valve washer 43 whenever any downstream pressure exceeds upstream or supply pressure to prevent concentrate containing water from entering the fresh water supply. A sharpened projection 43S prevents turbulence and is rigidified by a tack-like device which is molded into check valve element 43-1. A vent hole member 44 projects into the annular passage 45 in body member 40 and the vent 45V is sealed by the engagement therewith by elastomeric check valve element 43-1 with the opening of vent hole member 44. Vent 45 can open to atmosphere, but, preferably vents back into the container C so that possibly dangerous chemicals are not loosed in an unintended manner. In case the vent 45V is not required, it can, of course, be eliminated.

Three ball valves 47-1, 47-2 and 47-3 are rotatably mounted in ball valve socket or seats 48-1, 48-2 and 48-3, respectively, and, as shown, the valves need not be of the same size. Each of the ball valves has a shaft 49-1, 49-2 and 49-3 integral with operating knobs 49-1H, 49-2H, 49-3H, respectively, (see FIG. 1). Individual "o"-rings 49-10, 49-20 and 49-30 seal the valves. Ball valve handle 49-1H controls the flow of water to the impeller or rotor 70; ball valve handle 49-2H controls the flow of water to the fresh water bypass and ball valve handle 49-3H controls the flow of water to fill the tank or container and flush the screen at the lower end of the siphon pump vacuum tube.

In the embodiment of FIGS. 4 and 5 (in which flow direction is reversed), a conventional brass female fitting 31′ receives the male threads of a garden hose, for example. A sealing washer (not shown) may be typically provided. A valve body housing 40′ has a projection 42′ with a flange 42F around which the brass fitting 35 rotates to secure to the end of a hose. This forms the input to water supply under pressure and forms part of the input flow path or passage for water flowing through the apparatus. A check valve 43F carried on a pivot pin 43PP in bearings 43-B1 and 43-B2 respectively, serves as an anti-siphon valve to prevent concentrate carrying water from flowing back into a home water supply. Flapper check valve 43 is formed of a semi-rigid elastomeric material which seals against valve seat 43VS at any time the pressure in the valve body per se is greater than the upstream pressures. Spring 43FS is coiled around valve pivot pin 43PP and has an arm 43AR which is biased by engagement with the end of set screw 43SS to adjust the tension of the spring as applied to flapper valve 43F to thereby serve as a water pressure regulator. Pivot pin 43PP is hollow and has a small transverse bore 43TB which is exposed to the interior of the valve body when the pressure therein causes flap valve 43F to seal against surface 43VS. A four-way "T" valve rotor 48-49-SH is coupled through a shaft 49 to an operating handle or lever 49-SH which can be in any one of four modes, namely, off, "fill tank" in which case a flow path is provided from the input valve passage I through valve rotor body 40' to an output passage OP-2 which couples to a short tube (see FIG. 8) which projects into the interior of the container on which the lid or cover is fastened to fill the container C; a "utility" position in which a passageway OP-3 in valve body 40 couples the input I with output passage OP-3and a hose coupled to fitment FOP-2 to wash the user's hands, for cleaning filters and for in effect providing portable a faucet or tap for a supply of clean water for whatever useful purposes desired by the user; and, finally, a "concentrate" position in which a passageway in valve body 40 couples the input I to a passage OP-1 leading to the rotor or impeller 70. A cover plate 59 is fastened by screws or an adhesive to seal the valve body 40. The operating shaft 49-2 of the rotor 40V projects through a seal 50 in cap 59 to provide a projection for the securement of operating knob or handle 49SH thereto by means of a screw in threaded bore 61. The screws or fasteners 62 which secure the valve in assembly can, of course, pass through the top deck 61 of lid or cover 10 to mount this multiple valve unit in position proper orientation and position with respect to the next element in the assembly. The basic housing can be molded as an integral portion of cover or lid 10.

Figure 9:
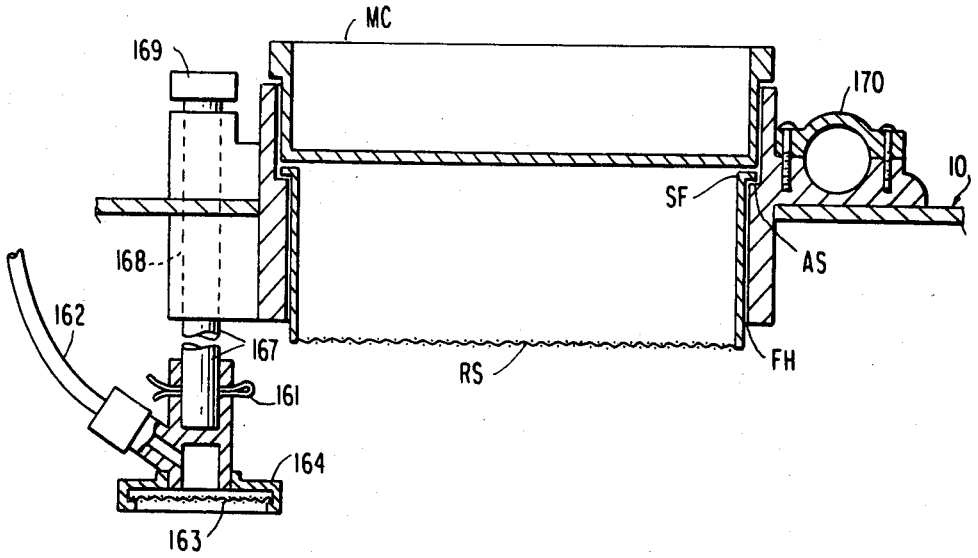
FIG. 9 is a partial side elevational view showing the concentrate fill screen and cap and vacuum tube screen and screen clean tube.

As shown in FIGS. 1 and 9, the fill oval shaped hole FH is provided with a removable screen RS into which concentrate, dry or liquid, is poured and initially mixed with water to make a liquid concentrate which is to be mixed with more water for dispensing and dispersion. Fill hole FH is provided with an annular shoulder AS on which screen flange SF rests and a molded plastic cap MC snuggly fits in oval fill opening FH.

AGITATOR DRIVE

Figure 7:
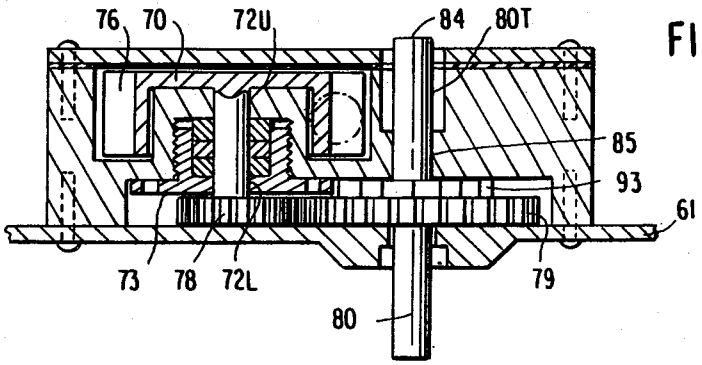
FIG. 7 is a sectional side elevational view showing the interrelationship rotor, gear drive and the manual gear drive.

The agitator drive (FIG. 7) includes an impeller or rotor 70 on shaft or axle 71 journeled in bearing means 71 and 72 which may be lubricated via threaded seal cap 73 through which shaft 71 projects. Impeller 70 has a plurality of impeller blades or buckets 76 which are shaped to be impinged upon by water issuing through outlet 77 of the multiple valve unit 40 and thereby rotate shaft or axle 71 and spur gear 78 which is secured thereto. Spur gear 78 is meshed with large gear 79 to form a step down (about 3.5:1) gearing to rotate off-center shaft 80 which is coupled to agitator shaft 81 and agitator 82 via a releasable coupling, such as cotter-pin 83. It will be appreciated that while in most cases a step down or lowering in the rate of rotation of agitator 82 is desired, some concentrates may require the agitator blade 82 to be rotated at a very high rate of speed so the gearing may be 1:1 ratio or even a step up gearing ratio may be used. A separate water bypass (not shown) may be incorporated to feed water directly from the input to the siphon pump in which case the agitator feature would not be used.

The top or upper end 80T of shaft 80 is provided with a highly visible brightly colored marker 84 so that the user can visually observe rotation of the shaft and hence be assured of proper operation of the rotor and attendant agitation and stirring of the liquid concentrate in the container while it is being dispensed and mixed with water. In conjunction with the siphon or jet pump indicator 130, described in detail hereafter, a glance at the apparatus assures the user that the concentrate mixture is being maintained substantially uniform and that it is being mixed with water at the rate selected. The upper end of shaft 80 projects through a seal bearing 85 and is square or hexagonal or otherwise shaped to receive a manual handle or crank 86 for initial agitation of the concentrate prior to turning the water on. This assures that the initial dispensing and mixing of the concentrate results in a more uniform spreading of concentrate mixed with water. Also, a few rotations of the handle will rotate the agitator or stirrer 82 and facilitate and make it easier for the water driven impeller 70 to agitate the concentrate, particularly when a dry insecticide or fertilizer, for example, is desired to be dissolved in a few gallons of water, there is an initial dissolving period where the dry material will settle; or the concentrate may have settled out between uses, etc. Crank 86 is normally stored on spring clip 87 which can be formed in the molding of the body of lid or cover or be a separate plastic or metal spring clip.

O-ring seals may be used throughout the unit where a shaft, for example, a valve stem or rotating shaft, or two components mate for a water flow passage to provide seals between such surfaces. As shown in FIGS. **10*a* and 10*b*, a pawl 90 pivotted on pin 91 is biased by spring 92 into operative engagement with ratchet wheel 93 having teeth 94 to prevent counter-rotation of impeller or rotor 70** and prevent cranking in the wrong direction. It also serves as a further safety to prevent backflow of concentrate into the fresh water supply.

THE SIPHON OR JET PUMP

The siphon or jet pump assembly includes the pump 100 per se, a mixture adjust valve 110, check valve 120 and indicator 130 and a gauge 140. As shown in FIGS. 11 and 12, the jet pump includes a body 101 having a water input threaded bore 102 for receiving water as it leaves impeller or rotor 70. A constricted orifice 103 is formed in brass insert 104 seated in recess 104R of housing 101, and a tapering bore 103T downstream of orifice 103 leaves to an output fitment OPF threadably received in threaded bore 101-TB and which locks brass insert 104 securely in position. Due to the venturi effect, the downstream side of the constricted orifice is at a low pressure creating vacuum or suction condition which is used for pumping concentrate from the container C. A suction bore 104B (FIG. **4*b*) communicates through a mixture adjust valve 110 and a ball valve 120 to suction tube 140** in the container C.

Mixture adjust valve 110 has an annular body 110-1 with three different sized or cross-sectioned bores 110-B1, 110-B2, and 110-B3 therein communicating with a hollow interior 110H1 which, in turn, communicates with a T-member 115 having a passage or leg 115BP connected to suction tube 116 and another leg or passage 115WP leading to the fresh water supply for backwashing the filter screen at the lower end of the suction tube (see FIG. 9) when the valve element 49-3H (FIG. 1) is open. Mixture adjust valve body 110-1 has an operate shaft 110-OS carrying a seating flange 110-SF which seats on the base of bore 111 and assures proper alignment of calibrated valve holes 110-B1, 110-B2 and 110-B3 with the suction bore 104-B. Threaded gland nut 112 mounts the valve stem in bore 111 and an O-ring 111-O assures that there is no leakage. A knurled knob 110KB secured to the outer end of operating shaft 110-OS is used to rotate one of the calibrated valve holes into alignment with venturi hole 104B. When no hole is aligned, the jet or siphon pump is "off" and pure water from the downstream side of the impeller 70 is delivered to the output hose.

Figure 13:
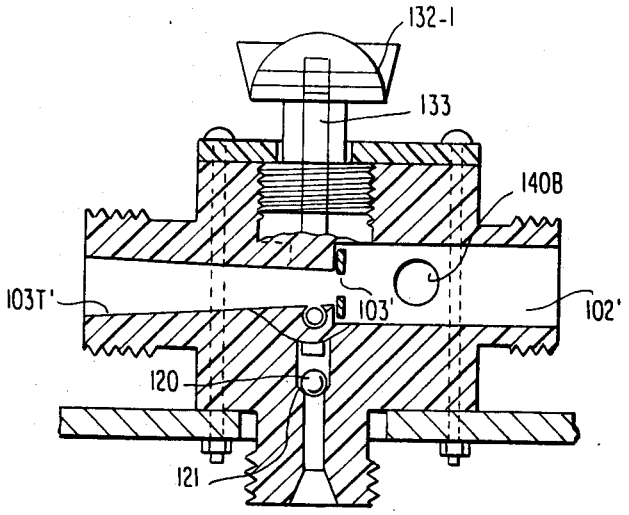

A visual indication of proper operation of the venturi is provided. Ball valve element 120 is on a ball valve seat 121 so flow of concentrate through leg 115P of the T-joint 115 raises or lifts ball 120. A plastic stem 130 rests on ball 120 and is raised thereby into a slot 131 in plastic magnifying lens element 132 which is threadably and sealingly received in bore 132B. The upper end 133 of stem 130 is colored a bright color, such as fluorescent red or fluorescent yellow, so that it is easily visible, with the degree of visibility e.g., the amount the stem is moved into slot 131, being a function of the concentrate flowing through the bore 104B. Thus, as an indication of the operation of the siphon pump, when the mixture adjust valve is on "off", the upper end 133 is not visible. At setting "1", which may be the smallest bore opening (110B1), a small portion of the tip 133 will show and at setting No. 3, the maximum amount of the tip will show and be enlarged by the magnifying lens. In the modification shown in FIGS. 13 and 14, the mixture adjust valve is a needle valve 110N which has a valve seat 110VS. The position of the valve can be provided by an indicator on adjust knob 110K or, alternatively, a detent, not shown, may be used to advise the user of particular settings of the needle valve 110 relative to valve seat 110VS. As further alternative, shims 110SH may be inserted under flange 110F so as to limit the amount of opening of the valve. In this particular embodiment, the siphon pump can be shut off by maintaining the ball valve seated blocking the passageway. This includes a threaded bore in the housing member and the threaded engagement of the magnifying lens element 132' has a depending leg 132-3 which engages and maintains the ball on the seat. The threaded shaft constitutes cam means for contacting the ball element and maintaining it seated. A vent passage 137 prevents air lock from interfering with free movement of the indicator.

Figure 16:
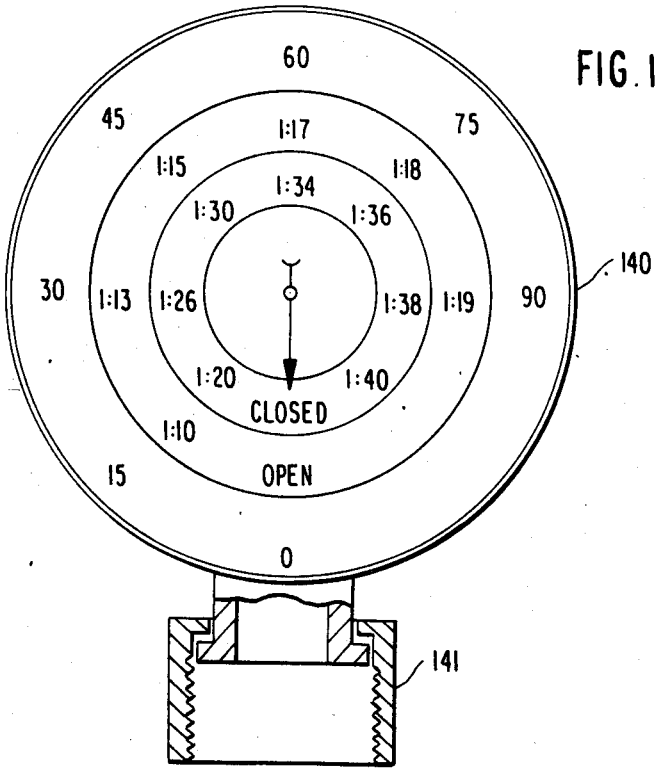
FIG. 16 is a top plan view of the pressure gauge dial assembly incorporated in the invention.
Figure 10A:
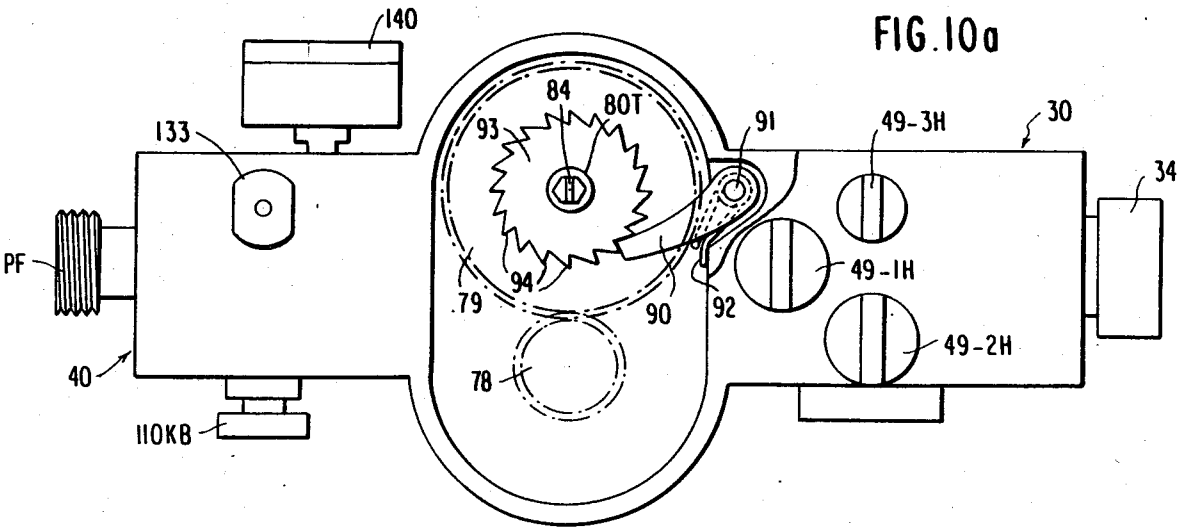
FIG. 10*a* and 10*b* are top plan and side elevational views of a modification of the gear drive.
Figure 10B:
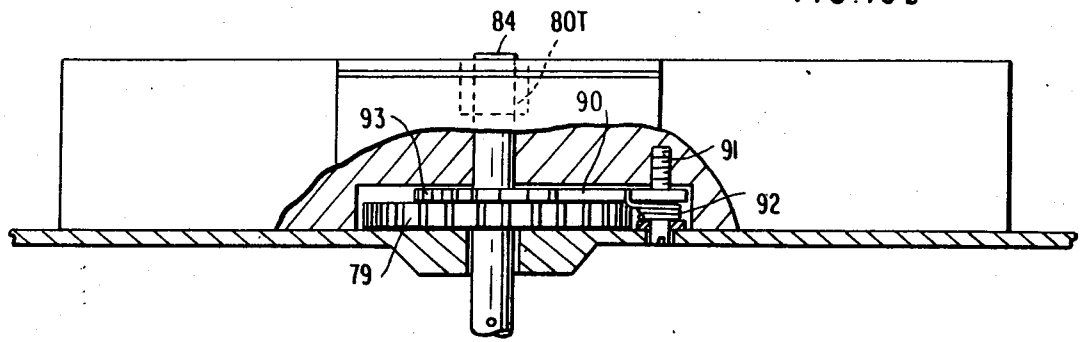
Figure 14:
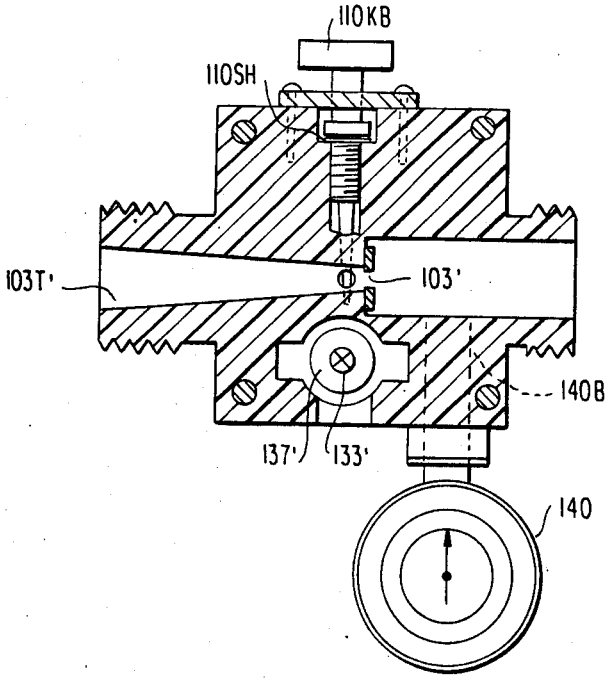
Figure 15:
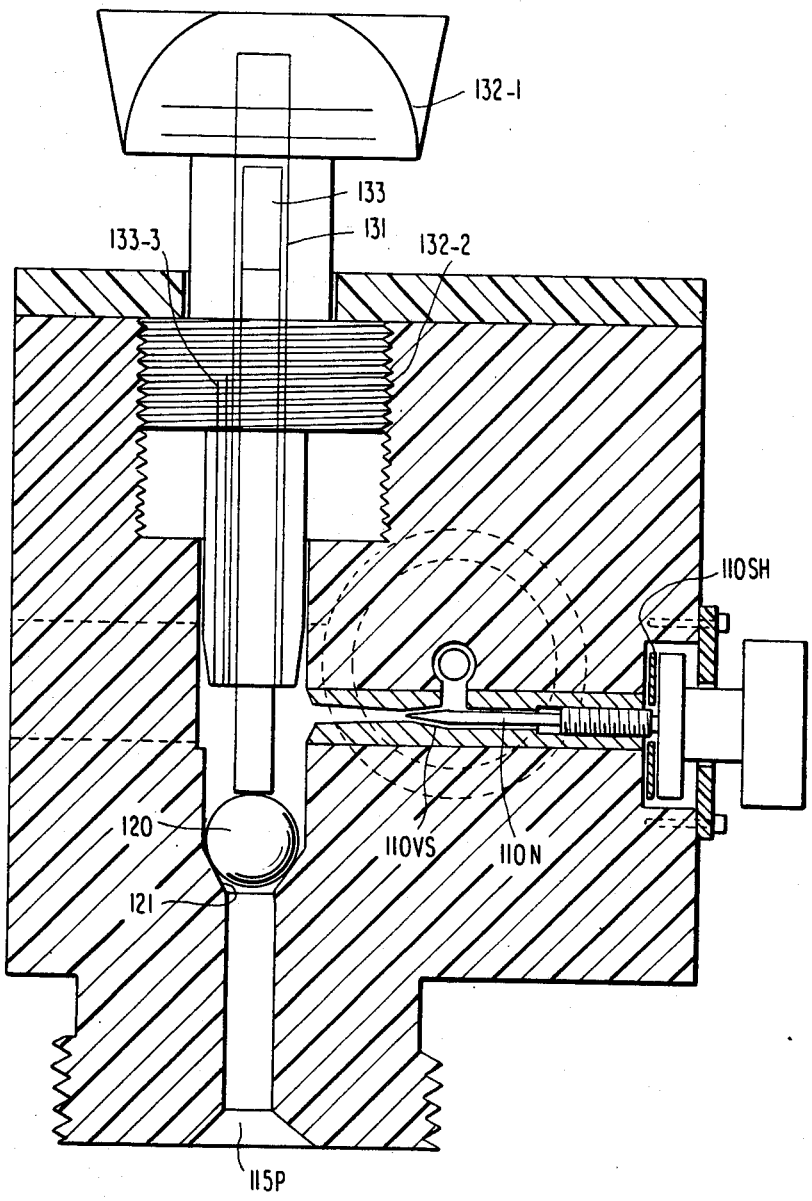
FIG. 15 is an enlarged view of a modified jet pump, ball check valve-indicator and needle valve assembly of FIGS. 13 and 14.

The amount of suction generated in the venturi of the jet siphon pump for high pressure is substantially linear as is disclosed in the aforementioned Parker U.S. Pat. No. 2,215,132 and the ratio of concentrate mixture to water pressure can therefore be calibrated accordingly. In FIG. 16, the gauge 140 is coupled by a fitment 141 to the upstream side of the jet pump as indicated in FIG. 14 and would be coupled to the embodiment shown in FIG. 11 via gauge bore 140B. The gauge 140 is a conventional water pressure gauge in which the dial has been adapted to indicate water pressure and, with a given setting of the mixture adjust valve what the concentrate to water ratio is at a given pressure. The gauge shown in FIG. 16 is for two settings of the needle valve but it will be appreciated that three corresponding settings of the gauge can be shown for three bore openings of the mixture adjust valve shown in FIGS. 11 and 12.

Figure 8:
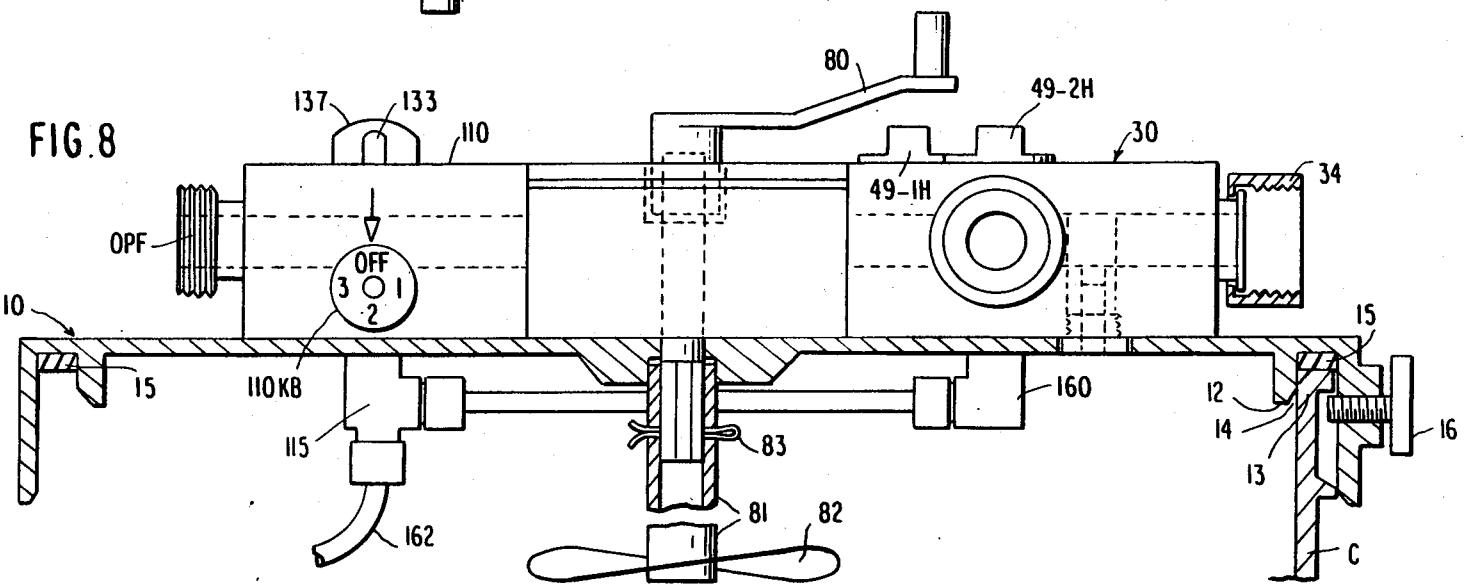
FIG. 8 is a side elevational view showing the interrelationship of the multiway input valving, rotor gear and manual lines, siphon pump and pump tube filter screen cleaning arrangement.

As shown in FIG. 8, ball valve 49-3 controls flow of fresh water through outlet passage OP-2 to elbow 160 short tube or passage 161 which is coupled to "T" element 115 on the jet pump assembly 110 and the suction tube 162. Thus, when the mixture control valve 110 is off, the tank or container C can be filled with fresh water and, at the same time, filter screen 163 (FIG. 9) can be flushed with fresh water to clear it of solid particles which may have adhered thereto. As shown in FIG. 9, filter screen 163 is on the end of a molded plastic snap on member 164 which, in turn, is secured by a telescopically cotter pin 162 to shaft 167. Shaft 167 passes through mounting bore 168 molded in lid 10 and has a knob 169 on the outer end so that the filter screen assembly can be pulled up for inspection through fill hole FH without removal of the lid from the container, which further protects the user in case insecticides or fungicides which can be dangerous, are being dispersed. Clamp 170 can be used for holding the crank handle 80 or a short section of hose. Shaft 167 maintains the filter screen and hence the end of suction tube in a predetermined position relative to agitator 82. However, in some cases, it may be desirable to use a flexible suction tube and provide weights on the end thereof, such as the filter screen 163 and snap-on member 164 to tilt this container and allow all the contents to be dispersed.

While there has been shown and described the preferred embodiment of the invention along with several modifications thereof, it will be appreciated that many other modifications and adaptations of the invention will become apparent to those skilled in the art and it is intended that the accompanying claims encompass those embodiments which would be obvious to those skilled in the art.

What is claimed is:

1. In a water operated dispersion system in which water under pressure drives a rotor coupled to an agitator immersed in a constituent to be mixed and dispersed with the water, and water from said rotor operates a jet pump having a suction passage for suctioning said constituent from a container therefor, the improvement comprising, means for indicating to the user operation of said agitator means.

2. In a water operated dispersion system in which water under pressure drives a rotor coupled to an agitator immersed in a constituent to be mixed and dispersed with the water, and water from said rotor operates a jet pump having a suction passage for suctioning said constituent from a container therefor, the improvement comprising, a metering valve in said suction passage and a pressure gauge measuring the pressure of water entering said jet pump, and a dial on said pressure gauge calibrated to indicate to the user the ratio of water to constituent dispersed at a predetermined setting of said metering valve.

3. In a water operated dispersion system in which water under pressure drives a rotor coupled to an agitator immersed in a constituent to be mixed and dispersed with the water, and water from said rotor operates a jet pump having a suction passage for suctioning said constituent from a container therefor, the improvement comprising, and including a multiway control valve means upstream of said rotor for:

1. supplying water to fill said container,
2. supplying water to said rotor.

4. The dispersion system defined in claim 3 including check valve means upstream of said multiway control valve means to prevent contamination of water upstream of said dispersion system.

5. In a water operated dispersion system in which water under pressure drives a rotor coupled to an agitator immersed in a constituent to be mixed and dispersed with the water, and water from said rotor operates a jet pump having a suction passage for suctioning said constituent from a container therefor, the improvement comprising, including means for indicating to the user operation of said jet pump and wherein said means for indicating to the user operation of said jet pump includes, an annular valve seat coaxial with said suction passage, a ball member seatable on said valve seat in the absence of suction in said suction passage to said jet pump, and flag means actuated by flow of constituent from said container through said suction passage.

6. The dispersion system defined in claim 5 including means for maintaining said ball member in engagement with said annular valve seat to prevent flow of constituent in said suction passage.

7. The dispersion system defined in claim 5 including a threaded bore located above said suction passage, a hollow indicator and shut-off shaft having external threads threadably engaged with said threaded bore, said flag means freely moving in said hollow indicator and shut-off shaft.

8. The dispersion system defined in claim 7 wherein said hollow shaft includes an enlarged end formed of clear plastic to magnify the appearance of said flag due to flow of fluid in said suction passage.

9. In a water based dispersion system in which water under pressure drives a rotor coupled to an agitator immersed in a constituent to be mixed and dispersed with the water, the improvement comprising, gear means coupling said rotor to said agitator, and including means for indicating to the user rotation of said gear means by said rotor.

10. The dispersion system defined in claim 9, including pump means operated by said water under pressure for pumping the constituent to be mixed from said container and to be dispersed with said water.

11. In a water based dispersion system in which water under pressure drives a rotor coupled to an agitator immersed in a constituent to be mixed and dispersed with the water, the improvement comprising, gear means coupling said rotor to said agitator, said gear means is a step down gear, and further including crank means for manually rotating said agitator.

12. In a jet pump and mixing system having a housing member with a water inlet and a water outlet, an orifice between said water inlet and said water outlet and a suction passage coupled to the downstream side of said orifice, the improvement comprising, indicator means in said suction passage and movable by fluid flow in said suction passage for indicating operation of said jet pump.

13. The jet pump and mixing system defined in claim 12 wherein said indicator means includes a ball element, an annular valve seat surrounding said suction passage and receiving said ball element, and means for indicating movement of said ball element.

14. The jet pump and mixing system defined in claim 13 including means for maintaining said ball element on said annular ball seat to prevent flow of fluid through said suction passage.

15. The jet pump and mixing system defined in claim 14 wherein said means for maintaining said ball element on said annular ball seat includes a bore in said housing member, an operating member, and cam means between said operating member and said bore.

16. The jet pump and mixing system defined in claim 15 wherein said cam means includes a threaded shaft for contacting said ball element and a threaded bore in said housing member threadably engaged with said threaded shaft.

17. The jet pump and mixing system defined in claim 16 wherein said threaded shaft has a hollow bore therein, and an indicator means freely movable in said bore and resting on said ball element so that when said ball element is free to move from said annular valve seat, said indicator means is moved by said ball.

18. The jet pump and mixing system defined in claim 12 including a calibrated metering valve element in said suction passage.

19. The jet pump and mixing system defined in claim 18 wherein said metering valve element is a needle valve having a control shaft, a valve element on the end of said control shaft, a valve seat, and means for limiting the closure of said valve a predetermined amount relative to said valve seat.

20. The jet pump and mixing system defined in claim 19 wherein said control shaft is threadably engaged with a threaded bore in said housing and said means for limiting includes a knob on the end of said control shaft and shim means between said knob and said housing.

21. The jet pump and mixing system defined in claim 20 including pressure gauge means coupled to said water inlet and dial means on said gauge means correlating the water pressure to said needle valve and indicate to the user the ratio of water flow through said inlet to fluid flow through said suction passage.

22. The jet pump and mixing system defined in claim 12 including pressure gauge means coupled to said water inlet, said pressure gauge means having a dial graduated to indicate the ratio of water flow through said inlet to fluid flow through said suction passage.

23. The jet pump and mixing system defined in claim 22 including a calibrated metering valve means for controlling flow of fluid in said suction passage.

24. The jet pump and mixing system defined in claim 23 including a movable member in said suction passage for indicating flow of fluid through said suction passage.

25. A water jet pump and mixing and dispersion system comprising in combination:

A. a cover for a container, and means for securing said cover on said container, B. rotor means, agitator means adapted to be immersed in liquid substance to be mixed and dispersed with water, gear means coupling said rotor means to said agitator means, handle and crank means removably coupled to the shaft of said gear means, C. multiple way valve means for:

a. delivering water to said water driven rotor, b. water to auxiliary uses including filling of said container, D. jet pump means having a conduit for receiving water under pressure from said water driven rotor means, an orifice of reduced section and having an input side and a discharge side, a tapered section on the discharge side of said orifice, and means forming a suction passage in communication with said container and the discharge side of said orifice, E. metering valve means in the said suction passage, F. check ball and valve seat means in said suction passage, means for securing said check ball in said valve seat to block flow of material from said container through said suction passageway, G. first indicator means for indicating operation of said jet pump, said indicator means comprising rod means resting on said check ball, a hollow member having a closed bore therein and a transparent closed bore end surrounding said rod means with the end of said rod means being rendered visible upon the unseating of said check ball means due to flow of concentrate from said container.

* * * * *